US009014602B2

(12) United States Patent
Sueoka

(10) Patent No.: US 9,014,602 B2
(45) Date of Patent: Apr. 21, 2015

(54) IMAGE FORMING APPARATUS INCLUDING INTERMEDIATE TRANSFER MEMBER VELOCITY CONTROL FEATURE

(75) Inventor: Takenori Sueoka, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 588 days.

(21) Appl. No.: 12/909,322

(22) Filed: Oct. 21, 2010

(65) Prior Publication Data

US 2011/0097096 A1 Apr. 28, 2011

(30) Foreign Application Priority Data

Oct. 28, 2009 (JP) ..... 2009-247457

(51) Int. Cl.

| | |
|---|---|
| ***G03G 15/01*** | (2006.01) |
| ***G03G 15/20*** | (2006.01) |
| ***G03G 15/16*** | (2006.01) |
| ***G03G 15/00*** | (2006.01) |

(52) U.S. Cl.

CPC .... *G03G 15/1605* (2013.01); *G03G 2215/0129* (2013.01); *G03G 2215/1623* (2013.01)

(58) Field of Classification Search

USPC ..... 399/49, 66, 302, 303, 308

See application file for complete search history.

(56) References Cited

U.S. PATENT DOCUMENTS

| | | | | |
|---|---|---|---|---|
| 6,324,355 | B1 | 11/2001 | Matsui et al. | |
| 7,483,650 | B2 * | 1/2009 | Freudenberg et al. | 399/167 |
| 2009/0317104 | A1 | 12/2009 | Katoh et al. | |

FOREIGN PATENT DOCUMENTS

| | | | |
|---|---|---|---|
| EP | 1031887 | A2 | 8/2000 |
| EP | 1031887 | A3 | 1/2004 |
| EP | 1031887 | B1 | 2/2007 |
| JP | 11-249526 | A | 9/1999 |
| JP | 2000-081794 | A | 3/2000 |
| JP | 2004-287337 | A | 10/2004 |
| JP | 2005-215482 | A | 8/2005 |
| JP | 2006-039268 | A | 2/2006 |
| JP | 4147310 | B2 | 9/2008 |

* cited by examiner

*Primary Examiner* — Joseph S Wong

(74) *Attorney, Agent, or Firm* — Fitzpatrick, Cella, Harper & Scinto

(57) ABSTRACT

An image forming apparatus includes an image bearing member which bears a toner image, an intermediate transfer member which bears the toner image transferred from the image bearing member, an endless recording material-conveying member which conveys a recording material, and a transfer portion which transfers the toner image to the recording material conveyed from the intermediate transfer member by the recording material-conveying member, wherein a perimeter of the intermediate transfer member is set to substantially an integral multiple of a perimeter of the recording material-conveying member.

4 Claims, 10 Drawing Sheets

IMAGE FORMING APPARATUS INCLUDING INTERMEDIATE TRANSFER MEMBER VELOCITY CONTROL FEATURE

BACKGROUND OF THE INVENTION

1. Field of the Invention

The present invention relates to an image forming apparatus using an electrophotographic system such as a copying machine and a laser beam printer, and more particularly, to an image forming apparatus which transfers a toner image transferred onto an intermediate transfer member to a recording material which is conveyed by a recording material-conveying member.

2. Description of the Related Art

Conventionally, intermediate transfer systems are widely used as an image forming apparatus of an electrophotographic system. According to the intermediate transfer system, a photosensitive drum is electrically charged by an electrically charging device, is exposed to light by an exposure device, and is developed by a developing device. After a toner image on a surface of the photosensitive drum is primarily transferred onto the intermediate transfer member which is opposed to the photosensitive drum, the toner image is secondarily transferred onto a recording material by a recording material-conveying member.

The intermediate transfer system has an issue that color is deviated in the primary transfer, and magnification of an image is varied. Causes thereof are inconsistencies in thickness of the intermediate transfer member, inconsistencies in rotational velocity of the intermediate transfer member caused by eccentricity of a drive roller which rotates the intermediate transfer member, and inconsistencies in rotational velocity of a photosensitive drum caused by eccentricity of the photosensitive drum.

An invention described in Japanese Patent Application Laid-Open No. 2004-287337 relates to a technique in which to suppress an influence of inconsistencies in rotational velocity of an intermediate transfer member, the intermediate transfer member is calibrated, the rotational velocity is detected and the rotational velocity of the intermediate transfer member is controlled to a constant velocity. An invention described in U.S. Pat. No. 6,324,355 relates to a technique in which to suppress an influence of inconsistencies in rotational velocity of an intermediate transfer member, a thickness of the intermediate transfer member is detected and the rotational velocity of the intermediate transfer member is controlled. An invention described in Japanese Patent Application Laid-Open No. 11-249526 relates to a technique in which to suppress an influence of inconsistencies in rotational velocity of an intermediate transfer member, a perimeter of a photosensitive drum and a perimeter of the intermediate transfer member are set to an integral multiple of a perimeter of a drive roller of the intermediate transfer member.

However, when a toner image is secondarily transferred onto a recording material adsorbed on the recording material-conveying member, the recording material-conveying member causes inconsistencies of the rotational velocity by inconsistencies of thickness, a velocity difference is generated between the intermediate transfer member and the recording material-conveying member and the image magnification is prone to be varied at the time of the secondary transfer. The variation in the image magnification caused by the recording material-conveying member cannot be corrected only by detecting the velocity and thickness of the intermediate transfer member and by setting a perimeter of the intermediate transfer member which are the conventional techniques.

The present invention provides an image forming apparatus capable of easily correcting variation in image magnification which is generated when the recording material-conveying member is used.

SUMMARY OF THE INVENTION

There is provided an image forming apparatus including an image bearing member which bears a toner image, an intermediate transfer member which bears the toner image transferred from the image bearing member, an endless recording material-conveying member which conveys a recording material, and a transfer portion which transfers the toner image to the recording material conveyed from the intermediate transfer member by the recording material-conveying member, wherein a perimeter of the intermediate transfer member is set to substantially an integral multiple of a perimeter of the recording material-conveying member.

Further features of the present invention will become apparent from the following description of exemplary embodiments with reference to the attached drawings.

DESCRIPTION OF THE EMBODIMENTS

Embodiments of the present invention will be described in detail with reference to the drawings. Sizes, materials, shapes and relative positions of constituent parts described in the embodiments are appropriately changed according to configurations and various conditions of the apparatus to which the invention is applied. Therefore, the scope of the invention is not limited to those unless such sizes, materials, shapes or relative positions are specifically described.

[First Embodiment]

Figure 1:
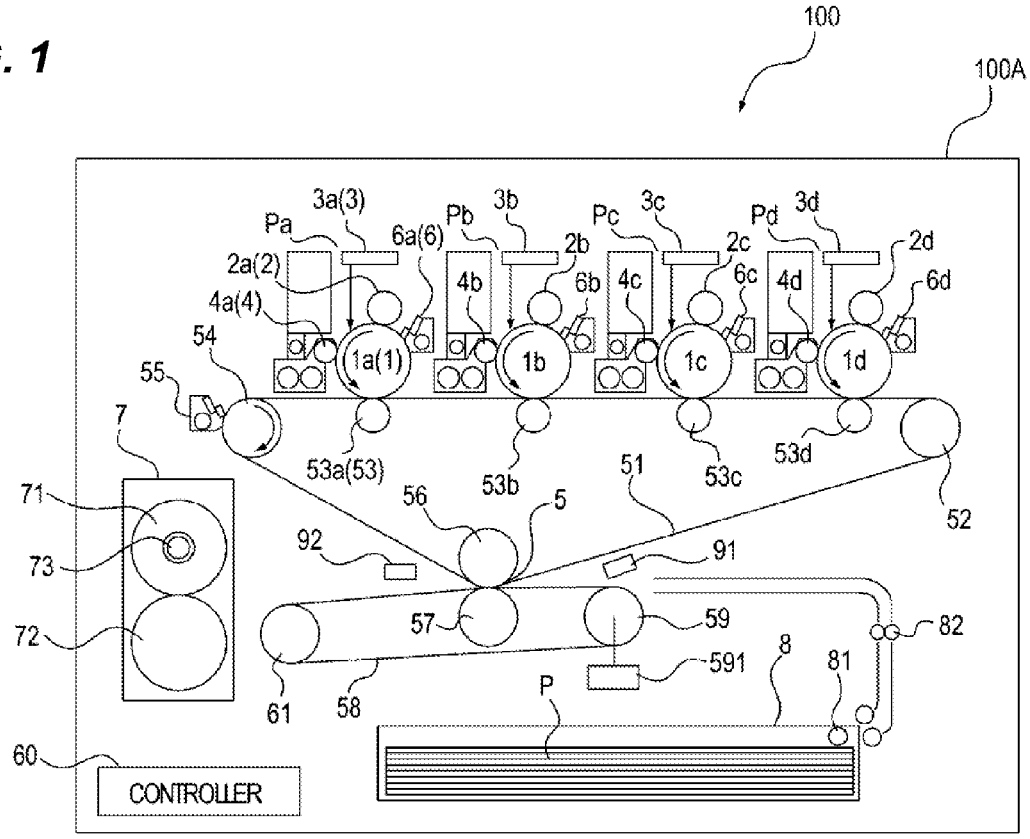
FIG. 1 is a sectional view illustrating a configuration of an image forming apparatus according to a first embodiment of the invention.

FIG. 1 is a sectional view illustrating a configuration of an image forming apparatus 100 according to a first embodiment of the present invention. The image forming apparatus 100 utilizes an electrophotographic image forming process. As illustrated in FIG. 1, the image forming apparatus 100 includes photosensitive drums 1 (1*a*, 1*b*, 1*c*, 1*d*) which are image bearing members for bearing a toner image, and charging rollers 2 (2*a*, 2*b*, 2*c*, 2*d*) which are charging units. The image forming apparatus 100 further includes exposure devices 3 (3*a*, 3*b*, 3*c*, 3*d*) which are exposure units, developing devices 4 (4*a*, 4*b*, 4*c*, 4*d*) which are developing units, and cleaning devices 6 (6*a*, 6*b*, 6*c*, 6*d*) which are cleaning units. The letters "a", "b", "c" and "d" are added to the reference numerals such as 2, 3, 4 and 6, but "a" corresponds to yellow, "b" magenta, "c" cyan, and "d" black.

The image forming apparatus 100 includes an intermediate transfer belt 51 which is an endless intermediate transfer member opposed to the photosensitive drum 1. The image forming apparatus 100 further includes drive rollers 54 and 52 which are first drive rollers for driving the intermediate transfer belt 51, and primary transfer rollers 53 (53*a*, 53*b*, 53*c*, 53*d*) which are first transfer portions for transferring a toner image from the photosensitive drum 1 to the intermediate transfer belt 51. It is possible to employ a configuration in which one of the drive rollers 54 and 52 is a drive roller, and the other roller is a driven roller. The image forming apparatus 100 also includes a secondary transfer counter roller 56 which is opposed to a secondary transfer roller 57 through the intermediate transfer belt 51 and a secondary transfer conveyance belt 58. The letters "a", "b", "c" and "d" are added to the reference numeral 53, but "a" corresponds to yellow, "b" magenta, "c" cyan, and "d" black.

The image forming apparatus 100 includes a secondary transfer conveyance belt 58 which is an endless recording material-conveying member for conveying a recording material P. The image forming apparatus 100 includes drive rollers 59 and 61 which are second drive rollers for driving the secondary transfer conveyance belt 58, and a secondary transfer roller 57 which is a secondary transfer portion for transferring a toner image to the recording material P. The recording material P is conveyed from the intermediate transfer belt 51 by the secondary transfer conveyance belt 58. It is possible to employ a configuration in which one of the drive rollers 59 and 61 is a drive roller, and the other one is a driven roller. In addition, in the image forming apparatus 100, a perimeter of the intermediate transfer belt 51 is set to substantially an integral multiple of a perimeter of the secondary transfer conveyance belt 58. The perimeter of the intermediate transfer belt 51 is set to an integral multiple of a perimeter of the drive roller 54 which is the first drive roller. The perimeter of the secondary transfer conveyance belt 58 is set to an integral multiple of a perimeter of the drive roller 59 which is the second drive roller.

Further, the image forming apparatus 100 includes a fixing apparatus 7 and a sheet cassette 8. The image forming apparatus 100 includes a photo-sensor 91 which is a first velocity detector for detecting velocity of the intermediate transfer belt 51, and a photo-sensor 92 which is a second velocity detector for detecting velocity of the secondary transfer conveyance belt 58. When the photosensitive drum 1, the intermediate transfer belt 51 and the primary transfer roller 57 form a pattern of a toner image on the intermediate transfer belt 51, the photo-sensor 91 which is also a first reading unit reads the pattern transferred onto the intermediate transfer belt 51, and the photo-sensor 92 which is also a second reading unit reads the pattern transferred onto the secondary transfer conveyance belt 58. The image forming apparatus 100 includes a control unit 591 which controls rotational velocity of the drive roller 59. The photosensitive drum 1, the charging roller 2, the exposure device 3, the developing device 4 and the cleaning device 6 constitute four process units for forming an image of yellow, magenta, cyan, and black.

The image forming apparatus 100 includes a controller 60. The controller 60 calculates a velocity difference between belts which is a velocity difference between the intermediate transfer belt 51 and the secondary transfer conveyance belt 58 based on velocity of the intermediate transfer belt 51 detected by the photo-sensor 91, and velocity of the secondary transfer conveyance belt 58 detected by the photo-sensor 92. The controller 60 controls rotational velocity of the drive roller 59 which is a second drive roller based on the velocity difference between the belts. The controller 60 calculates velocity of the intermediate transfer belt 51 from a pattern length and a distance between patterns read by the photo-sensor 91 with respect to an elapsed time. The controller 60 calculates velocity of the secondary transfer conveyance belt 58 from a pattern length and a distance between patterns read by the photo-sensor 92 with respect to an elapsed time.

Next, an image forming operation of the image forming apparatus 100 will be described. First, a charging roller 2*a* disposed above a photosensitive drum 1*a* comes into contact with the photosensitive drum 1*a* which is rotating in the direction of the arrow and the photosensitive drum 1*a* is charged. An electrostatic image corresponding to image information is formed by an exposure device 3*a* on the charged photosensitive drum 1*a* downstream of the charging roller 2*a*. A developing device 4*a* is disposed downstream of the exposure device 3*a*. The developing device 4*a* supplies toner to the electrostatic image on the photosensitive drum 1*a*, and a toner image is formed. The above-described procedure is carried out on four process units Pa, Pb, Pc and Pd.

Primary transfer rollers 53*a*, 53*b*, 53*c* and 54*d* are disposed below four photosensitive drums 1*a*, 1*b*, 1*c* and 1*d* through the intermediate transfer belt 51. A voltage corresponding to charge polarity and potential of the toner images formed on the photosensitive drums 1*a* to 1*d* is applied to the primary transfer rollers 53*a* to 53*d*, and the toner image on the photosensitive drums 1 is electrostatically transferred onto a surface of the intermediate transfer belt 51. The intermediate transfer belt 51 is rotated and driven in the direction of the arrow by the drive roller 54, and toner images of respective colors formed on the photosensitive drums 1*a* to 1*d* are sequentially transferred onto the intermediate transfer belt 51, thereby forming a full color image. The full color image is conveyed to a secondary transfer portion 5 by rotation drive of the intermediate transfer belt 51.

Recording materials P taken out from the sheet cassette 8 by this time are supplied to a conveying roller 82 through a pickup roller 81 and sent onto the secondary transfer conveyance belt 58. The secondary transfer conveyance belt 58 is rotated and driven in the direction of the arrow by the drive roller 59, and conveys the recording materials P to the secondary transfer portion 5. A voltage corresponding to charge polarity and potential of the toner image is applied to the secondary transfer counter roller 56 and the secondary transfer roller 57 in the secondary transfer portion 5, and the toner image on the intermediate transfer belt 51 is transferred onto the recording material P by the voltage. Residual transfer toner on the intermediate transfer belt 51 is removed and collected by a transfer belt cleaner 55.

The recording material P on which the toner image is transferred is separated from the secondary transfer conveyance belt 58, and is sent to the fixing apparatus 7. The fixing apparatus 7 includes a fixing roller 71 and a pressure roller 72, and a heater 73 is disposed in the fixing roller 71. The recording material P conveyed to the fixing apparatus 7 is heated and pressurized by the heater 73 when the recording material P passes between the fixing roller 71 and the pressure roller 72, and the toner image on the recording material P is melted and fixed as a full color image.

Next, the secondary transfer portion 5 possessed by the image forming apparatus 100 will be described in detail. The secondary transfer roller 57 forms a conductive rubber sponge having 6 mm thickness on a surface of a cored bar made of metal of $\phi 12$. Nitrile-butadiene rubber, ethylene-propylene-diene rubber or urethane in which ion conductive agent is mixed is used as the conductive rubber sponge. A conductive cylinder is brought into contact with the secondary transfer roller 57 under a weight of 1 kg, and the secondary transfer roller 57 is driven rotated by rotation of the conductive cylinder. In this state, a resistance value is obtained from a current flowing when 2 kV is applied to the cored bar, and a conductive rubber sponge having resistance of $1\times10^6$ to $1\times10^9\Omega$ is used. More preferably, a conductive rubber sponge having resistance of $1\times10^7$ to $1\times10^8\Omega$ is used. A voltage of 2 to 7 kV is applied to the secondary transfer roller 57 so that 20 to 70 μA flows through the secondary transfer roller 57 when the recording material P passes through the secondary transfer portion.

The intermediate transfer belt 51 is of a multi-layer structure in which a layer of dielectric resin such as polyimide in which carbon black is included, a resin layer using polyimide, a resilient layer using urethane, and a coating layer using fluorocarbon resin are combined. A belt having volume resistivity of $1\times10^8$ to $1\times10^{12}$ Ω·cm and thickness of 50 to 600 μm is used as the intermediate transfer belt 51. A rubber such as Nitrile-butadiene rubber, ethylene-propylene-diene rubber and urethane or resin material such as polyimide having thickness of 50 to 600 μm and volume resistivity of $1\times10^9$ to $1\times10^{16}$ Ω·cm is used as the secondary transfer conveyance belt 58. Or a material in which ion conductive agent having volume resistivity of $1\times10^7$ to $1\times10^{11}\Omega$·cm may be used as the secondary transfer conveyance belt 58.

A perimeter of the intermediate transfer belt 51 in this embodiment is set to an integral multiple of a perimeter of the secondary transfer conveyance belt 58. When the perimeter of the intermediate transfer belt 51 is 600 mm and the perimeter of the secondary transfer conveyance belt 58 is 200 mm, the secondary transfer conveyance belt rotates three times while the intermediate transfer belt rotates one time.

Figure 2A:
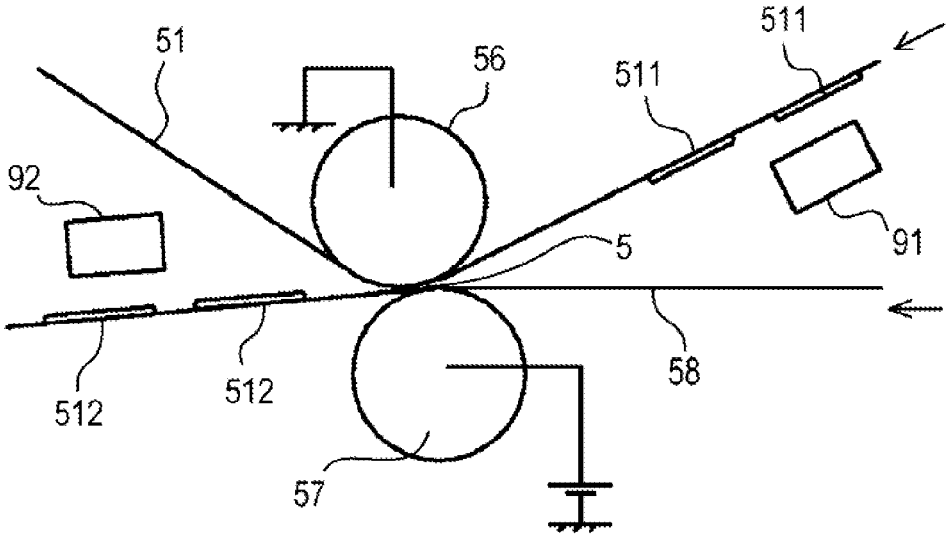
FIG. 2A is an enlarged sectional view illustrating a configuration of a secondary transfer portion.

FIG. 2A is an enlarged sectional view illustrating a configuration of the secondary transfer portion 5. As illustrated in FIG. 2A, the secondary transfer portion 5 includes the secondary transfer counter roller 56 disposed inside the intermediate transfer belt 51, and the secondary transfer roller 57 disposed inside the secondary transfer conveyance belt 58. The secondary transfer counter roller 56 and the secondary transfer roller 57 form a nip, thereby forming the secondary transfer portion 5. The photo-sensor 91 which is a first reading unit is disposed along the intermediate transfer belt 51 upstream of the secondary transfer portion 5 such that the photo-sensor 91 is opposed to the intermediate transfer belt 51. The photo-sensor 91 detects a toner image transferred onto the surface of the intermediate transfer belt 51. The photo-sensor 92 which is a second reading unit is disposed along the secondary transfer conveyance belt 58 downstream of the secondary transfer portion 5 such that the photo-sensor 92 is opposed to the secondary transfer conveyance belt 58. The photo-sensor 92 detects a toner image transferred onto the surface of the secondary transfer conveyance belt 58.

Figure 2B:
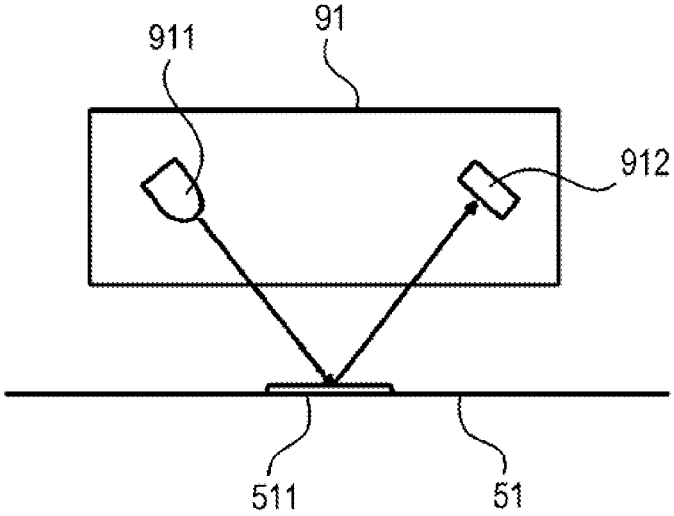
FIG. 2B is a sectional view illustrating a configuration of a photo-sensor.

FIG. 2B is a sectional view illustrating a configuration of the photo-sensor 91. As illustrated in FIG. 2B, the photo-sensor 91 includes a light emitting element 911 such as an LED and a light sensitive element 912 such as a photodiode. The pattern 511 is irradiated with light by the light emitting element 911, and the light sensitive element 912 detects the light reflected. The configuration of the photo-sensor 92 is the same as that of the photo-sensor 91.

Figure 3A:
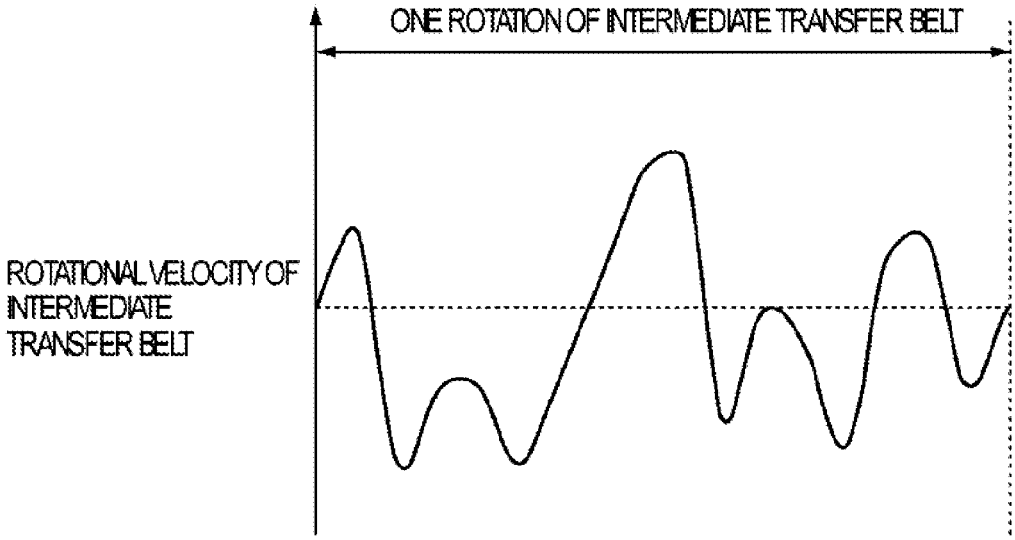
FIG. 3A is a graph illustrating transition of rotational velocity of an intermediate transfer belt while an intermediate transfer belt rotates one time.

FIG. 3A is a graph illustrating transition of rotational velocity of the intermediate transfer belt 51 while the intermediate transfer belt 51 rotates one time. As illustrated in FIG. 3A, the intermediate transfer belt 51 has inconsistencies in thickness and inconsistencies in rotational velocity.

Figure 3B:
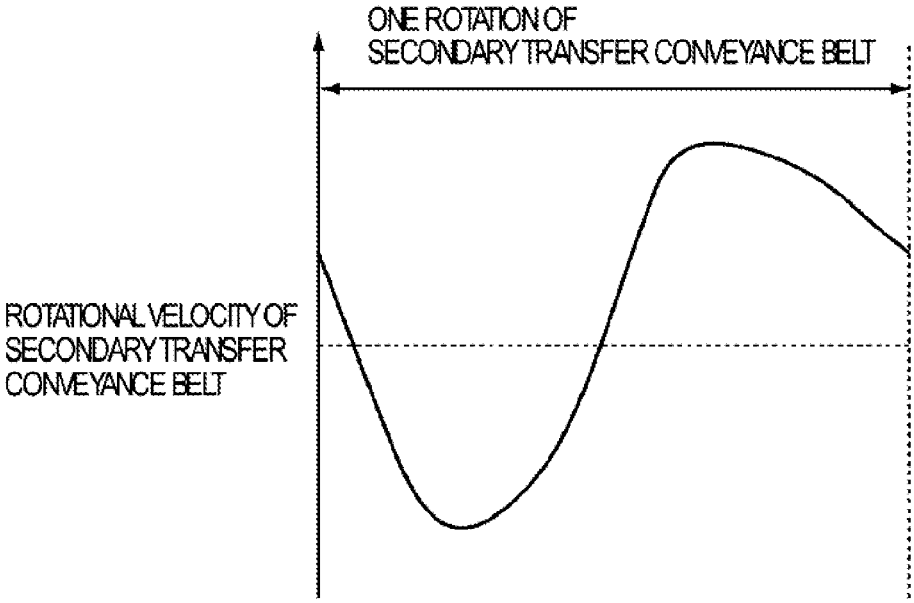
FIG. 3B is a graph illustrating transition of rotational velocity of a secondary transfer conveyance belt while the secondary transfer conveyance belt rotates one time.

FIG. 3B is a graph illustrating transition of rotational velocity of the secondary transfer conveyance belt 58 while the secondary transfer conveyance belt 58 rotates one time. As illustrated in FIG. 3B, the secondary transfer conveyance belt 58 has inconsistencies in thickness and inconsistencies in rotational velocity.

Figure 4A:
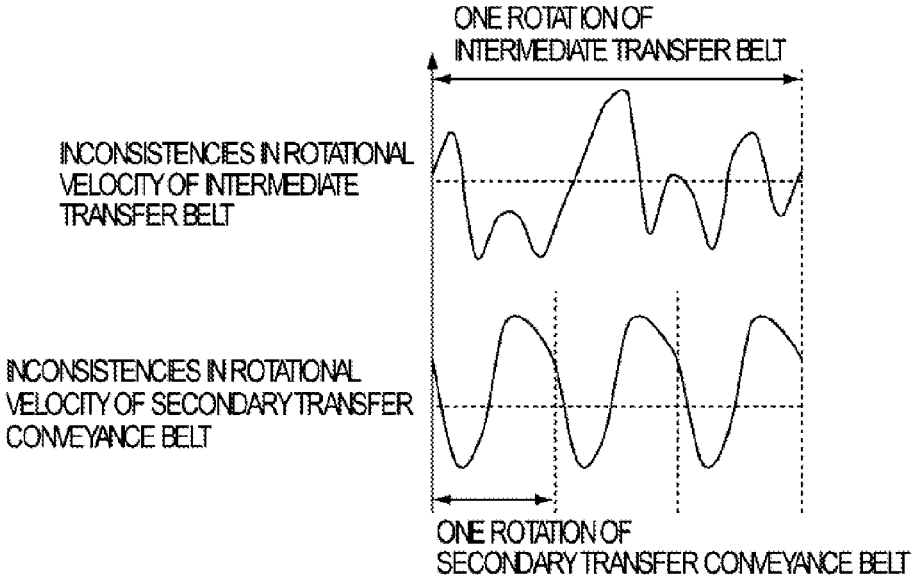
FIG. 4A is a graph illustrating a relation between inconsistencies in rotational velocity of the intermediate transfer belt and inconsistencies of rotational velocity of the secondary transfer conveyance belt.

FIG. 4A is a graph illustrating a relation between inconsistencies in rotational velocity of the intermediate transfer belt 51 and inconsistencies in rotational velocity of the secondary transfer conveyance belt 58. As illustrated in FIG. 4A, maximum values and minimum values of the rotational velocities of the intermediate transfer belt 51 and the secondary transfer conveyance belt 58 do not always match with each other.

Figure 4B:
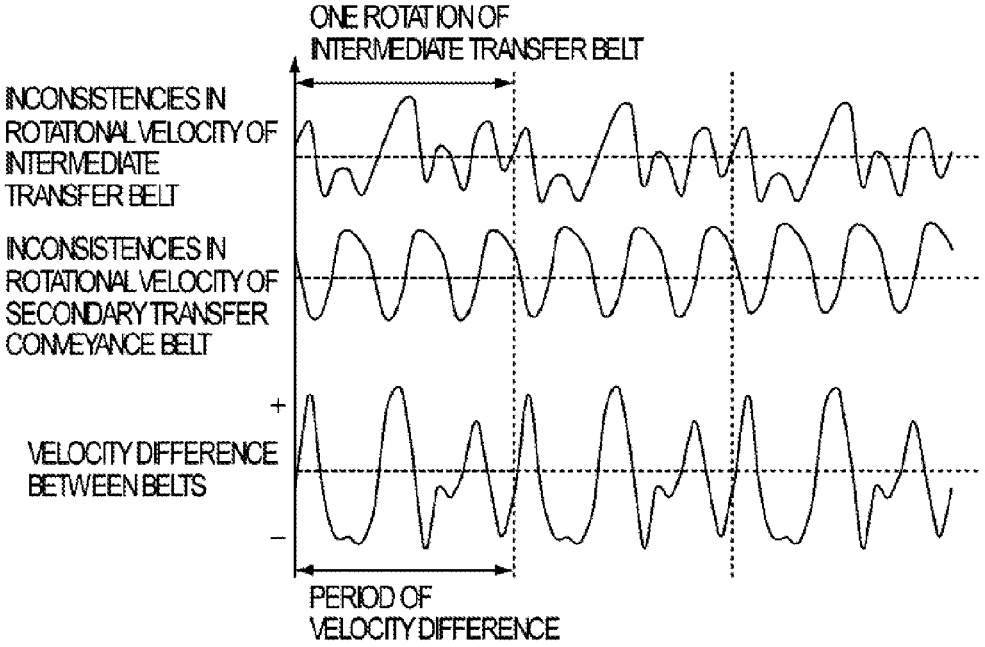
FIG. 4B is a graph illustrating transition of a velocity difference between the intermediate transfer belt and the secondary transfer conveyance belt.

FIG. 4B is a graph illustrating transition of a velocity difference between the intermediate transfer belt 51 and the secondary transfer conveyance belt 58. As illustrated in FIG. 4B, the velocity difference between the intermediate transfer belt 51 and the secondary transfer conveyance belt 58 becomes the same in every rotation of the intermediate transfer belt 51.

Figure 5A:
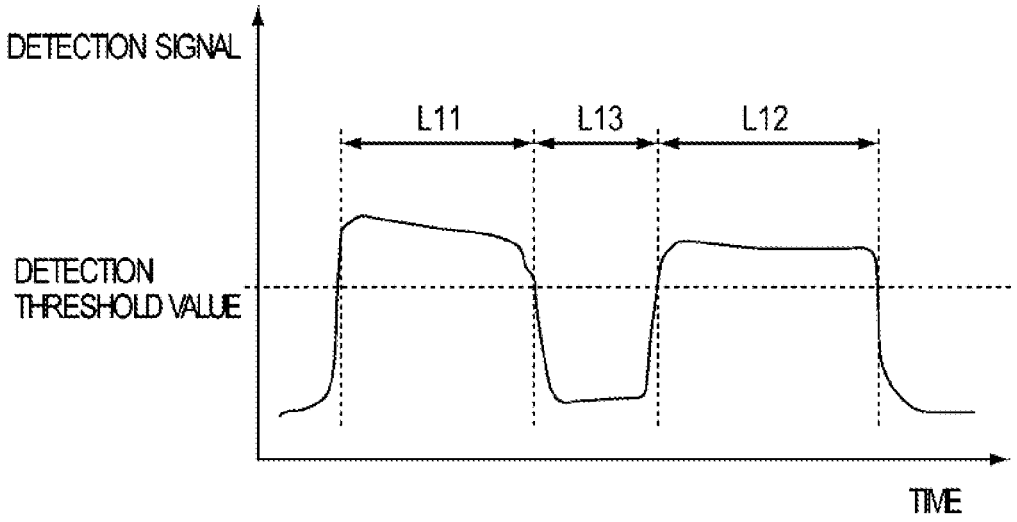
FIG. 5A is a graph illustrating variation with time of a signal detected by the photo-sensor.

FIG. 5A is a graph illustrating transition of a detection value of a signal detected by the photo-sensor 91 with respect to an elapsed time. As illustrated in FIG. 5A, the controller 60 calculates lengths L11 and L12 of the pattern 511 and a distance L13 between the patterns 511 from timing at which the pattern 511 exceeds a detection threshold value and from timing at which the pattern 511 becomes lower than the detection threshold value.

Figure 5B:
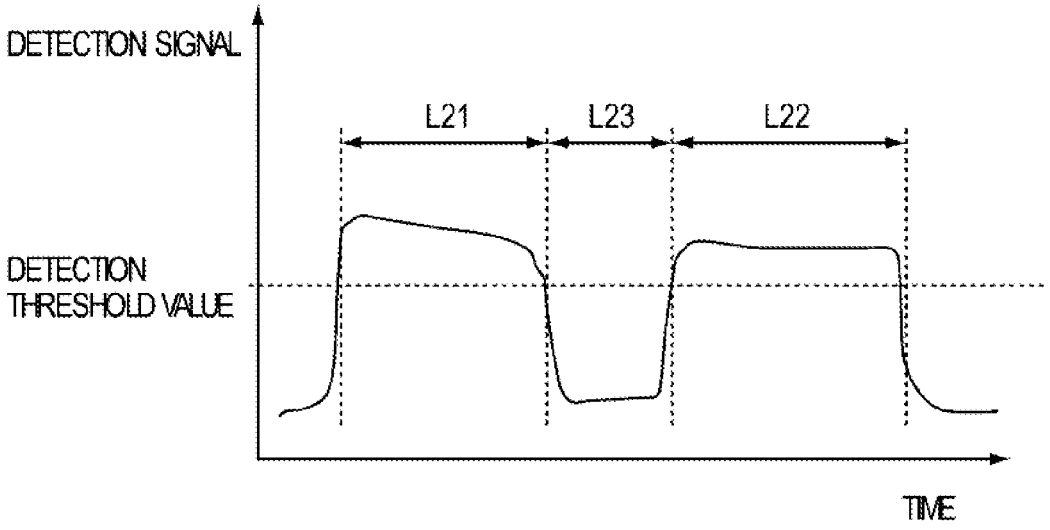
FIG. 5B is a graph illustrating transition of a detection value of a signal detected by the photo-sensor with respect to an elapsed time.

FIG. 5B is a graph illustrating transition of a detection value of a signal detected by the photo-sensor 92 with respect to an elapsed time. As illustrated in FIG. 5A, the controller 60 calculates a value corresponding to the length of the pattern 512 and a distance between the patterns 512 based on timing at which the pattern 512 exceeds a detection threshold value and based on timing at which the pattern 512 becomes lower than the detection threshold.

If a velocity difference exists between the intermediate transfer belt 51 and the secondary transfer conveyance belt 58, magnification of the transferred pattern is varied, and a difference is generated between pattern time lengths L11 and L21 corresponding to the length of the pattern. Similarly, differences are generated between the distance time lengths L12 and L22, and between the distance time lengths L13 and L23 corresponding to the distance between the patterns. Variations in magnification at that time become L21/L11, L22/L12, L23/L13, and variation of image magnification at a pattern forming position and a pattern non-forming position (pattern distance position) can be calculated.

A length of the pattern is 1 mm or more and 50 mm or less, and a distance of the patterns is 1 mm or more and 50 mm or less. When the perimeter of the intermediate transfer belt is 600 mm and the perimeter of the secondary transfer conveyance belt 58 is 200 mm, a pattern having a length of 10 mm and a distance of 5 mm is transferred over one rotation of the intermediate transfer belt 51, and the image magnification is detected. According to this, variation in image magnification of one rotation of the intermediate transfer belt 51 can be obtained based on variation in magnification of the pattern time length and distance time length of 40 locations.

Figure 6A:
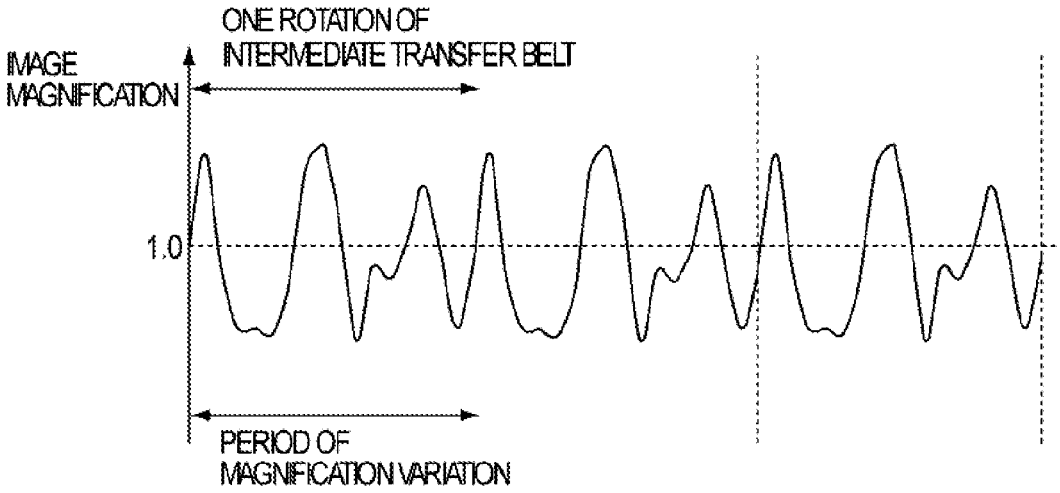
FIG. 6A is a graph illustrating a relation between an elapsed time and image magnification.

FIG. 6A is a graph illustrating transition of the image magnification with respect to an elapsed time. Since the above-described velocity difference between the intermediate transfer belt 51 and the secondary transfer conveyance belt 58 is the same every one rotation of the intermediate transfer belt 51 in the first embodiment, magnification variation of the pattern is also the same everyone rotation of the intermediate transfer belt 51 as illustrated in FIG. 6A. Therefore, if the variation in pattern magnification for one rotation of the intermediate transfer belt 51 is detected and the velocity difference between the intermediate transfer belt 51 and the secondary transfer conveyance belt 58 is obtained from a result of the detection, it is possible to estimate a velocity difference between these belts at second and subsequent rotations of the intermediate transfer belt 51.

Figure 6B:
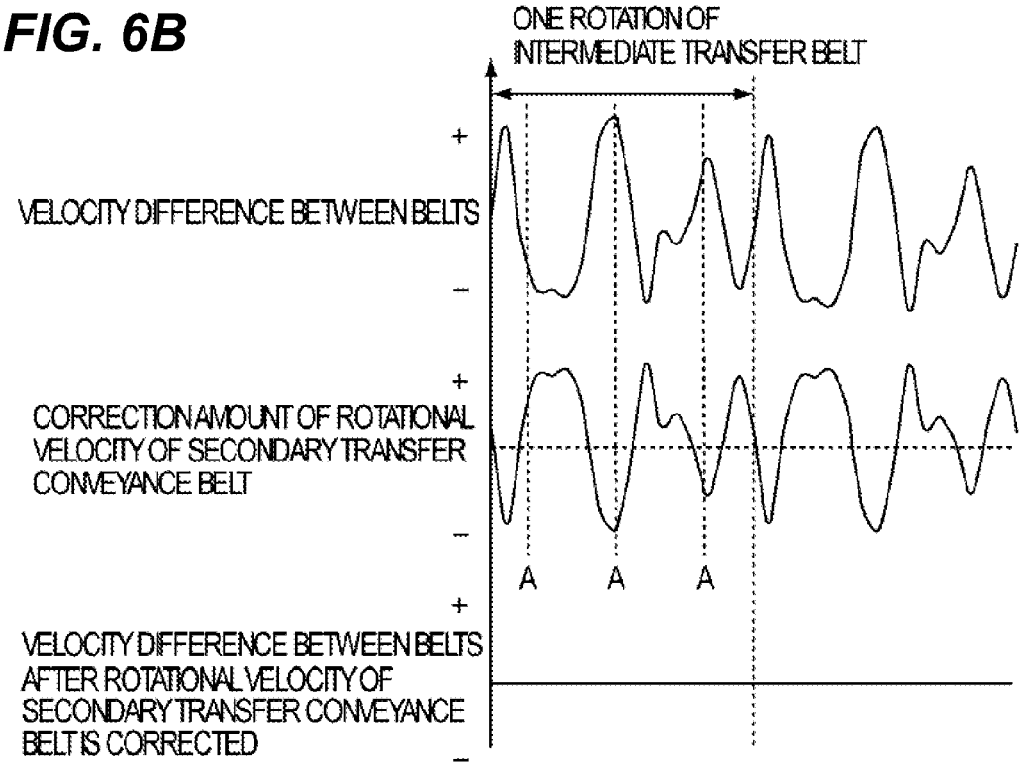
FIG. 6B is a graph illustrating a relation between a velocity difference between the belts and a correction amount of rotational velocity of the secondary transfer conveyance belt.

FIG. 6B is a graph illustrating a relation between the velocity difference between the belts and a correction amount of the rotational velocity of the secondary transfer conveyance belt 58. As illustrated in FIG. 6B, it is preferable that correction is made to accelerate or decelerate the rotational velocity of the secondary transfer conveyance belt 58 while the intermediate transfer belt 51 rotates onetime such that the velocity difference between the belts is eliminated by controlling the rotational velocity of the drive roller 59.

Figure 7:
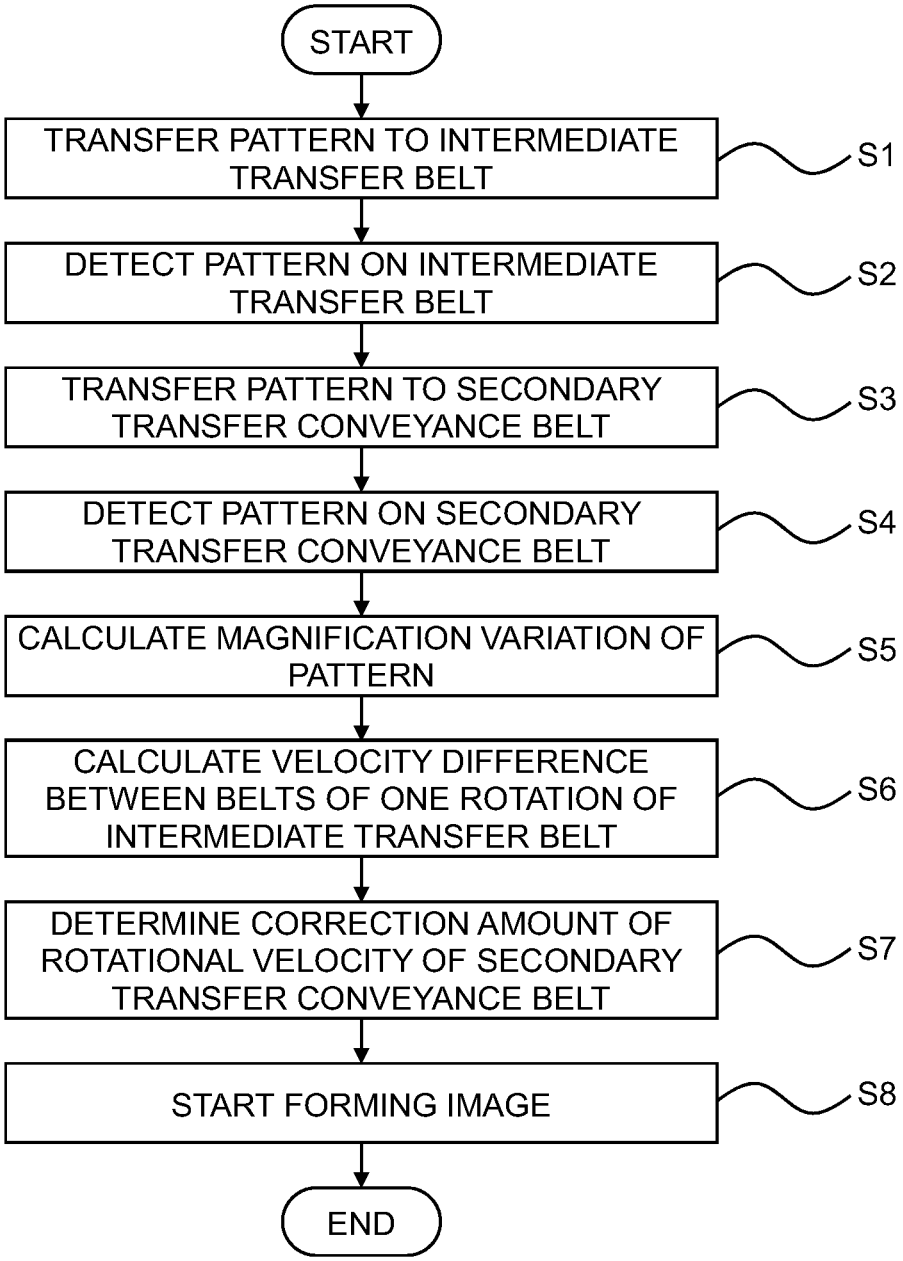
FIG. 7 is a flowchart illustrating a control procedure of a controller.

FIG. 7 is a flowchart illustrating a control procedure of the controller 60. As illustrated in FIG. 7, the controller 60 controls to correct the velocity difference between the belts. Before the controller 60 starts controlling and forms an image, the controller 60 transfers the pattern 511 on the intermediate transfer belt 51 for correcting the image magnification (step S1) (see FIG. 2A). The controller 60 controls such that the photo-sensor 91 detects the pattern 511 on the intermediate transfer belt 51 (step S2). Thereafter, the controller 60 controls such that the secondary transfer roller 57 and the secondary transfer counter roller 56 are driven while forming the secondary transfer portion 5, and the pattern 511 on the intermediate transfer belt 51 is transferred onto the secondary transfer conveyance belt 58 (step S3). Then, the pattern 511 on the intermediate transfer belt 51 is conveyed as a pattern 512 on the secondary transfer conveyance belt 58.

Next, the controller 60 controls such that the photo-sensor 92 detects the pattern 512 on the secondary transfer conveyance belt 58 (step S4). At the same time, the controller 60 controls such that the photo-sensor 91 detects the pattern 511 on the intermediate transfer belt 51.

The controller 60 obtains magnification variations L21/L11, L22/L12 and L23/L13 based on the pattern time lengths L11 and L12, the distance time length L13, the pattern time lengths L21 and L22, and distance time length L23. In this manner, the image magnifications at the pattern forming position and the pattern non-forming position (pattern distance position) are calculated (step S5).

The controller 60 calculates variation in pattern magnification of one rotation of the intermediate transfer belt 51 and based on its result, calculates the velocity difference between the intermediate transfer belt 51 and the secondary transfer conveyance belt 58, and calculates a velocity difference between the intermediate transfer belt 51 and the secondary transfer conveyance belt 58 at second and subsequent rotations (step S6).

The controller 60 performs acceleration or deceleration correction of the rotational velocity of the secondary transfer conveyance belt 58 while the intermediate transfer belt 51 rotates one time such that the velocity difference between the belts is eliminated by the control of rotational velocity of the drive roller 59 (step S7).

When the perimeter of the intermediate transfer belt 51 is 600 mm and the perimeter of the secondary transfer conveyance belt 58 is 200 mm, a position A on the secondary transfer conveyance belt 58 comes into contact with the intermediate transfer belt 51 three times while the intermediate transfer belt 51 rotates one time. It is assumed that a velocity difference between the belts at the time of a first contact is −0.3%, a velocity difference between the belts at the time of a second contact is +0.4%, and a velocity difference between the belts at the time of a third contact is +0.2%. In this case, the rotational velocity of the drive roller 59 at the position A is controlled to be +0.3% at the time of the first contact, −0.4% at the time of the second contact, and −0.2% at the time of the third contact. If the same control is performed at all of the locations where the velocity difference between the belts is detected, it is possible to eliminate the velocity difference between the belts under the same control for the pattern magnification at second and subsequent rotations of the intermediate transfer belt. Based on this correction, the controller 60 starts forming an image (step S8).

According to the image forming apparatus 100 described in the first embodiment, the controller 60 performs the following control based on the velocity of the intermediate transfer belt 51 detected by the photo-sensor 91, and the velocity of the secondary transfer conveyance belt 58 detected by the photo-sensor 91. That is, the controller 60 calculates the velocity difference between the intermediate transfer belt 51 and the secondary transfer conveyance belt 58, and controls the rotational velocity of the drive roller 59 based on the velocity difference between the belts. Since the perimeter of the intermediate transfer belt 51 is set to substantially the integral multiple of a perimeter of the secondary transfer conveyance belt 58, the velocity difference between the belts becomes the same everyone rotation of the intermediate transfer belt 51. Therefore, if the controller 60 calculates the velocity difference between the belts and controls the rotational velocity of the drive roller 59 based on the velocity difference between the belts, it is possible to control the rotational velocity of the secondary transfer conveyance belt 58 and corrects the velocity difference between the belts. As a result, variation in image magnification caused by the velocity difference between the belts is easily corrected. If the velocity difference between the belts at first rotation of the intermediate transfer belt 51 is corrected, the velocity difference between the belts of second and subsequent rotations of the intermediate transfer belt 51 can be corrected under the same control.

When the photosensitive drum 1, the intermediate transfer belt 51 and the primary transfer roller 57 form a pattern of a toner image on the intermediate transfer belt 51, the controller 60 performs the following control. That is, the controller 60 calculates the velocity of the intermediate transfer belt 51 based on pattern time lengths L11 and L12 corresponding to the length of the pattern read by the photo-sensor 91 with respect to the elapsed time, and from the distance time length L13 corresponding to a distance between patterns. The controller 60 calculates the velocity of the secondary transfer conveyance belt 58 from pattern time lengths L21 and L22 corresponding to the length of the pattern read by the photosensor 92 with respect to the elapsed time, and from the distance time length L23 corresponding to a distance between patterns. From this, variation in magnification of a pattern transferred to the intermediate transfer belt 51 and the secondary transfer conveyance belt 58 is detected. From this magnification variation of the pattern, a velocity difference between the intermediate transfer belt 51 and the secondary transfer conveyance belt 58 is detected, and a correction amount of the velocity difference between the belts is easily obtained.

Since the perimeter of the intermediate transfer belt 51 is set to substantially the integral multiple of a perimeter of the drive roller 54 which is the first drive roller, even if the drive roller 54 is deflected, inconsistencies in rotational velocity of the drive roller 54 appear at the same position on the intermediate transfer belt 51. Therefore, variation in a velocity difference between the intermediate transfer belt 51 and the secondary transfer conveyance belt 58 is suppressed.

Since the perimeter of the secondary transfer conveyance belt 58 is set to substantially the integral multiple of a perimeter of the drive roller 59 which is the second drive roller, even if the drive roller 59 is deflected, inconsistencies in rotational velocity of the drive roller 59 appear at the same position on the secondary transfer conveyance belt 58. Therefore, variation in a velocity difference between the intermediate transfer belt 51 and the secondary transfer conveyance belt 58 is suppressed.

[Second Embodiment]

Figure 8:
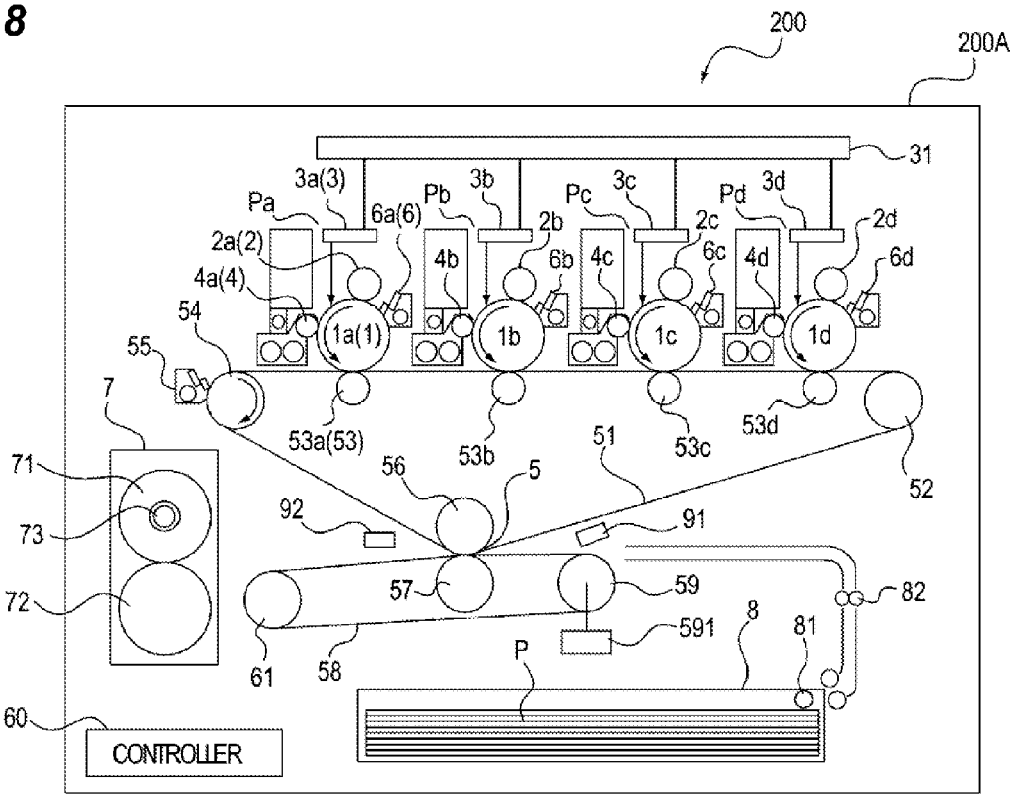
FIG. 8 is a sectional view illustrating a configuration of an image forming apparatus according to a second embodiment.

FIG. 8 is a sectional view illustrating a configuration of an image forming apparatus 200 according to a second embodiment. In the image forming apparatus 200 of the second embodiment, the same configuration and effect as those of the image forming apparatus 100 of the first embodiment are designated with the same reference numerals, and description thereof will not be repeated. The image forming apparatus 200 of the second embodiment is different from the image forming apparatus 100 of the first embodiment in that the image forming apparatus 200 includes an image formation timing control apparatus 31 as an image formation timing controller which is a controller. The image forming operation and the secondary transfer portion 5 of the image forming apparatus 200 are the same as those in the first embodiment.

The image formation timing control apparatus 31 distinctively operates the exposure device 3 which is an image forming portion for forming an electrostatic image on the photosensitive drum 1, and the developing device 4 which is a developing portion for developing the electrostatic image on the photosensitive drum 1 to form a toner image.

Further, a perimeter of the intermediate transfer belt 51 is set to substantially an integral multiple of a perimeter of the secondary transfer conveyance belt 58, the perimeter of the intermediate transfer belt 51 is set to substantially an integral multiple of a perimeter of the drive roller 54, and the perimeter of the photosensitive drum 1 is set to substantially an integral multiple of a perimeter of the drive roller 54. The perimeter of the secondary transfer conveyance belt 58 may be an integral multiple of a perimeter of the drive roller 59 which is a second drive roller. When the perimeter of the secondary transfer conveyance belt 58 is an integral multiple of a perimeter of the drive roller 59 which is the second drive roller, even if the drive roller 59 is deflected, the inconsistencies in rotational velocity of the drive roller 59 appear at the same position on the secondary transfer conveyance belt 58. Therefore, variation in a velocity difference between the intermediate transfer belt 51 and the secondary transfer conveyance belt 58 is suppressed.

The photo-sensor 91 functions as a first size detector, and detects a size of a toner image transferred onto the intermediate transfer belt 51. The photo-sensor 92 functions as a second size detector, and detects a size of a toner image transferred onto the secondary transfer conveyance belt 58.

When the photosensitive drum 1, the exposure device 3, the developing device 4, the intermediate transfer belt 51 and the primary transfer roller 57 form a pattern of a toner image on the intermediate transfer belt 51, the following operation is carried out. That is, the photo-sensor 91 which is the first size detector reads a toner image transferred onto the intermediate transfer belt 51, and the photo-sensor 92 which is the second size detector reads a toner image transferred onto the secondary transfer conveyance belt 58.

The image forming apparatus 200 includes the image formation timing control apparatus 31 as an image formation timing portion which is a different controller from the controller 60. Based on a size of a toner image on the intermediate transfer belt 51 detected by the photo-sensor 91 and a size of a toner image on the secondary transfer conveyance belt 58 detected by the photo-sensor 92, the controller 60 calculates image magnification transferred from the intermediate transfer belt 51 to the secondary transfer conveyance belt 58. The image formation timing control apparatus 31 controls timing at which the exposure device 3 which is an image forming portion forms an electrostatic image on a surface of the photosensitive drum 1 which is an image bearing member based on the image magnification.

The controller 60 calculates pattern time lengths L11 and L12 corresponding to a pattern length read by the photosensor 91 with respect to an elapsed time and distance time length L13 corresponding to a distance between patterns. Further, the controller 60 calculates pattern time lengths L21 and L22 corresponding to a pattern length read by the photosensor 92 with respect to an elapsed time and distance time length L23 corresponding to a distance between patterns. Based on them, the controller 60 calculates image magnification transferred from the intermediate transfer belt 51 to the secondary transfer conveyance belt 58.

Figure 9A:
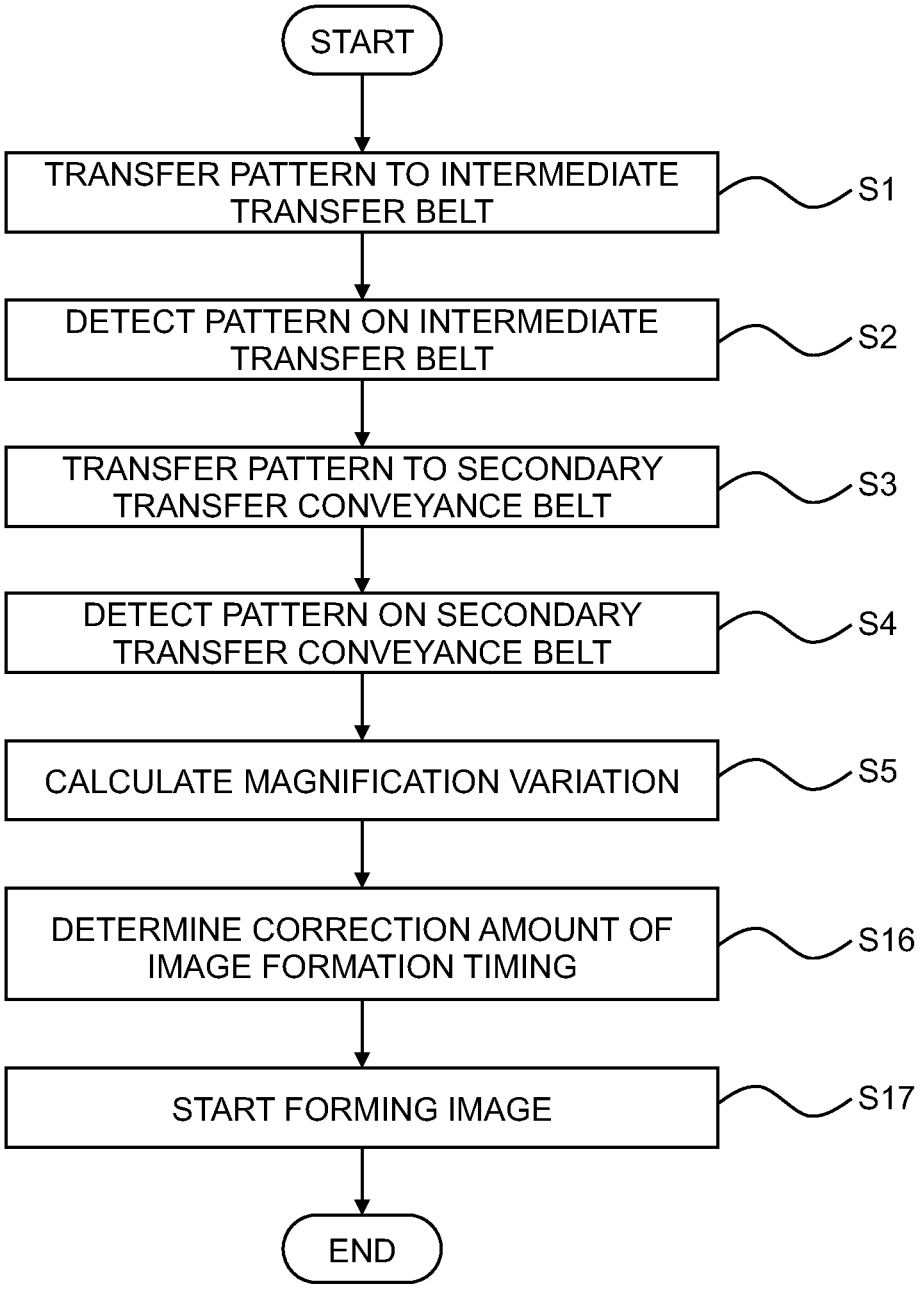
FIG. 9A is a flowchart illustrating a control procedure of a controller.

FIG. 9A is a flowchart illustrating an image forming procedure of the image forming apparatus 200 of the second embodiment. Since steps S1 to S5 are the same as those in the first embodiment, steps S1 to S5 in the first embodiment are used also in the second embodiment. In the second embodiment also, since the velocity difference between the intermediate transfer belt 51 and the secondary transfer conveyance belt 58 is the same in the period of the first rotation of the intermediate transfer belt 51, the magnification variation of a pattern is the same in the period of the first rotation of the intermediate transfer belt 51 as illustrated in FIG. 6A.

Figure 9B:
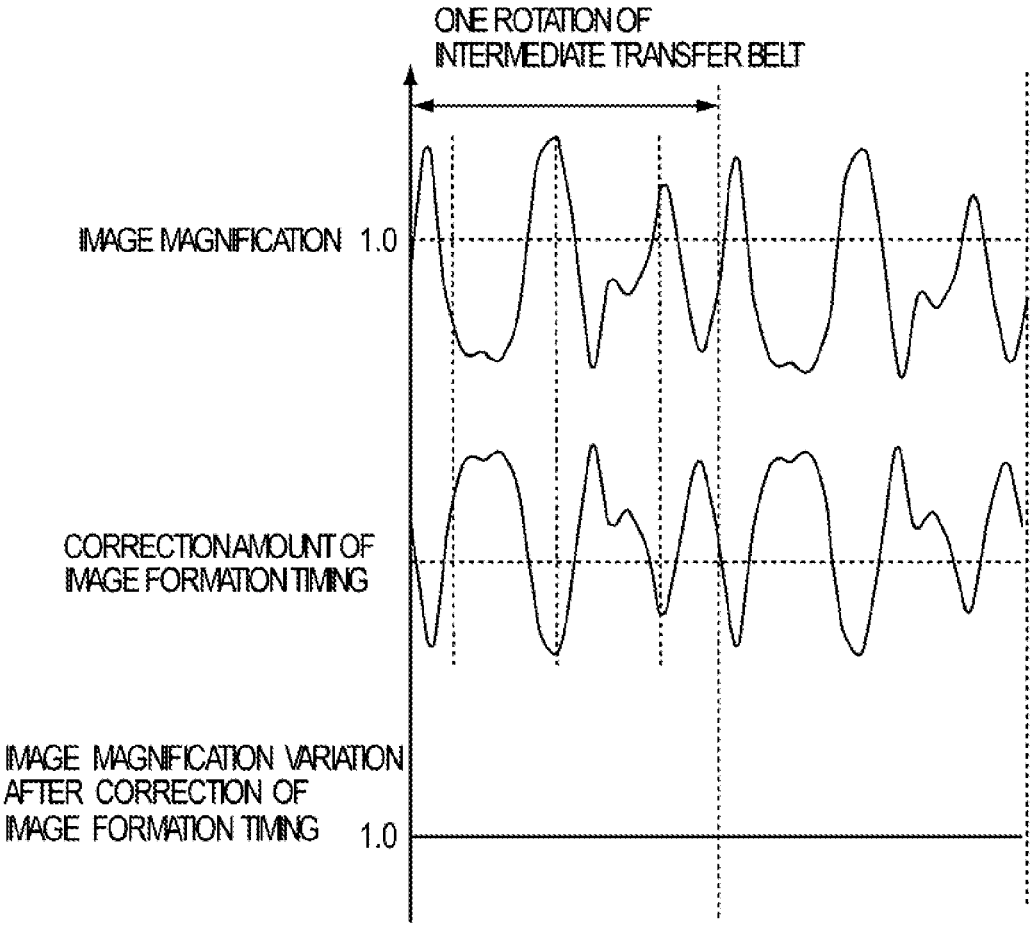
FIG. 9B is a graph illustrating transition of the image magnification, a correction amount of image formation timing and variation in image magnification after the image formation timing is corrected.

Therefore, if magnification variation of a pattern of a first rotation of the intermediate transfer belt 51 is detected, it is possible to estimate variation in image magnification of second and subsequent rotations of the intermediate transfer belt 51. Hence, as illustrated in FIG. 9B, the controller 60 controls the driving the image formation timing control apparatus 31, the image formation timing control apparatus 31 controls the image formation timing that the exposure device 3 forms an image on the photosensitive drum 1, so that image magnification is varied and an original image can be obtained (step S16). The controller 60 corrects the magnification variation of a pattern of second and subsequent rotations of the intermediate transfer belt 51 under the same control, controls the image formation timing control apparatus 31 and starts the image forming operation (step S17).

According to the image forming apparatus 200 described in the second embodiment, the controller 60 performs the following control based on a size of a toner image on the intermediate transfer belt 51 detected by the photo-sensor 91, and a size of a toner image on the secondary transfer conveyance belt 58 detected by the photo-sensor 92. That is, the controller 60 calculates image magnification transferred to the intermediate transfer belt 51 and the secondary transfer conveyance belt 58, and controls timing at which an electrostatic image is formed on a surface of the image bearing member. Since the perimeter of the intermediate transfer belt 51 is set to substantially the integral multiple of the perimeter of the secondary transfer conveyance belt 58, variation in image magnification in a secondary transfer is the same in the period of the first rotation of the intermediate transfer belt 51. Therefore, the controller 60 can calculate image magnification, and control timing at which the exposure device 3 forms an electrostatic image on the surface of the photosensitive drum 1 based on the image magnification, and correct the image magnification. As a result, variation in image magnification caused by variation in image magnification at the time of the secondary transfer is easily corrected. If the velocity difference between the belts at the first rotation of the intermediate transfer belt 51 is corrected, the velocity difference between the belts of second and subsequent rotations of the intermediate transfer belt 51 can be corrected under the same control.

When the photosensitive drum 1, the exposure device 3, the developing device 4, the intermediate transfer belt 51 and the primary transfer roller 57 form a pattern of a toner image on the intermediate transfer belt 51, the controller 60 performs the following control. The controller 60 calculates pattern time lengths L11 and L12 corresponding to a pattern length read by the photo-sensor 91 with respect to an elapsed time and distance time length L13 corresponding to a distance between patterns. Further, the controller 60 calculates pattern time lengths L21 and L22 corresponding to a pattern length read by the photo-sensor 92 with respect to an elapsed time and distance time length L23 corresponding to a distance between patterns. From them, the controller 60 calculates image magnification transferred from the intermediate transfer belt 51 to the secondary transfer conveyance belt 58. From this, variation in magnification of the pattern transferred to the intermediate transfer belt 51 and the secondary transfer conveyance belt 58 is detected. A correction amount of the image formation timing by the image formation timing control apparatus 31 is easily obtained.

As described above, according to the invention, a velocity difference of the intermediate transfer member and the recording material-conveying member are calculated based on velocity of the intermediate transfer member detected by the first velocity detector and velocity of the recording material-conveying member detected by the second velocity detector, and rotational velocity of the second drive roller is controlled based on this velocity difference. Therefore, if the controller calculates the velocity difference between the belts and controls the rotational velocity of the second drive roller based on the velocity difference between the belts, it is possible to control the rotational velocity of the recording material-conveying belt and to correct the velocity difference between the belts. As a result, variation in image magnification caused by the velocity difference between the belts is easily corrected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-247457, filed Oct. 28, 2009, which is hereby incorporated by reference herein in its entirety.

What is claimed is:

1. An image forming apparatus comprises:

an image bearing member configured to bear a toner image;

an intermediate transfer member configured to bear the toner image transferred from the image bearing member;

an endless recording material-conveying member configured not to form a toner image to be transferred on a recording material and configured to bear and convey a recording material; and a transfer portion configured to transfer the toner image from the intermediate transfer member to the recording material conveyed from the intermediate transfer member by the recording material-conveying member, wherein a perimeter of the intermediate transfer member is set to substantially an integral multiple of three of a perimeter of the recording material-conveying member.

2. The image forming apparatus according to claim 1, further comprising a first drive roller which drives the intermediate transfer member, wherein a perimeter of the intermediate transfer member is set to substantially an integral multiple of a perimeter of the first drive roller.

3. The image forming apparatus according to claim 2, further comprising a second drive roller which drives the recording material-conveying member, wherein a perimeter of the recording material-conveying member is set to substantially an integral multiple of a perimeter of the second drive roller.

4. The image forming apparatus according to claim 3, further comprising a test pattern forming portion configured to form a first test pattern on the intermediate transfer member, and to form a second test pattern transferred from the first test pattern at the transfer portion from the intermediate transfer member to the recording material-conveying member;

a first detector configured to detect the first test pattern on the intermediate transfer member; and a second detector configured to detect the second test pattern on the recording material-conveying member; and a controller configured to control rotational velocity of the second drive roller depending on an output of the first detector and the second detector so that a velocity difference between the intermediate transfer member and the recording material-conveying member becomes substantially constant or is eliminated.

* * * * *